US006556896B1

(12) United States Patent
Meyer

(10) Patent No.: US 6,556,896 B1
(45) Date of Patent: Apr. 29, 2003

(54) MAGNETIC ROLL RATE SENSOR

(75) Inventor: Steven J. Meyer, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/042,014

(22) Filed: Jan. 10, 2002

(51) Int. Cl.[7] ..... F42B 15/22
(52) U.S. Cl. ..... 701/3; 701/4; 244/3.1
(58) Field of Search ..... 701/3, 13, 14, 701/36, 4; 244/3.1, 3.15, 3.23, 3.11, 3.16, 3.22

(56) References Cited

U.S. PATENT DOCUMENTS 4,006,870 A * 2/1977 Boone et al. ..... 244/3.15
5,669,581 A * 9/1997 Ringer ..... 244/3.16
6,163,021 A * 12/2000 Mickelson ..... 244/3.1
6,456,905 B2 * 9/2002 Katz et al. ..... 701/4

* cited by examiner

*Primary Examiner*—Richard M. Camby
(74) *Attorney, Agent, or Firm*—David Kalmbaugh

(57) ABSTRACT

A magnetic roll rate sensor for measuring the roll rate or roll position of a missile. A pair of magnetic sensor elements mounted within the missile provide analog electrical signals representative of a change in the earth's magnetic field due to the presence of a ferromagnetic element within the field. The analog signals, representative of roll rate sensor data, are converted to a digital format, formatted into a PCM data stream and transmitted to a ground station. The ground station receives the PCM data stream, extracts the roll rate sensor data and processes the data using a personal computer to determine a roll rate for the missile.

20 Claims, 6 Drawing Sheets

MAGNETIC ROLL RATE SENSOR

BACKGROUND OF THE INVENTION

1. Field of the Invention

The present invention relates generally to an apparatus for sensing the roll rate of an item such as a spinning projectile. More specifically, the present invention relates to a magnetic roll rate sensor for sensing the roll rate or roll position of a missile which allows for a determination to be made of the missile's position in earth coordinates.

2. Description of the Prior Art

Currently, there is a need to measure the roll rate or roll position of a spinning projectile such as a missile. Measuring the roll rate or roll position of a rolling airframe, such as a missile can be very difficult, especially with respect to a smaller diameter missile. Some of these smaller diameter missiles have roll rates in excess of 20 revolutions per second. The diameter of such a projectile may be in the order of approximately 2.75 inches leaving very limited space for the roll rate sensor. Thus, bulky roll rate sensors, such as laser ring gyros and quartz rate sensors are not easily adapted for use in small diameter missiles.

The high roll rates of these small diameter missiles also cause position errors to occur during the missile's flight. For example, a quartz rate sensor measuring roll would require a range of ±7200 degrees to cover a missile having a roll rate of about 20 revolutions per second. Scale factor accuracy is typically about ± one percent of full scale for a quartz rate sensor. Thus, the position error for a ten second missile flight is ±720 degrees (±72 degrees per second times ten seconds). Added to this error are other error sources such as bias, linearity and g sensitivity.

Further, the cost of these roll rate sensors is significant, driving up missile production cost. Accordingly, there is a need for a smaller, less expensive, light weight, and very accurate roll rate sensor which measures the roll rate. or roll position of a missile in flight.

SUMMARY OF THE INVENTION

The roll rate sensor disclosed herein overcomes some of the disadvantages of the past including those mentioned above. It comprises a relatively simple in design yet highly effective and efficient device for measuring the roll rate or roll position of a small diameter projectile such as a missile.

A pair of magnetic sensor elements mounted within the missile provide analog electrical signals which indicate a change in the earth's magnetic field due to the presence of a ferromagnetic element within the field. The analog signals, representative of roll rate sensor data, are converted to a digital format, formatted into a PCM data stream and transmitted to a ground station via an RF (radio frequency) signal link in the form of a radio frequency signal. The ground station receives the PCM data stream, extracts the roll rate sensor data and processes the roll rate sensor data using a personal computer. The personal computer includes computer software which performs quadrature detection to determine roll rate for the missile.

DETAILED DESCRIPTION OF THE PREFERRED EMBODIMENTS

Figure 1:
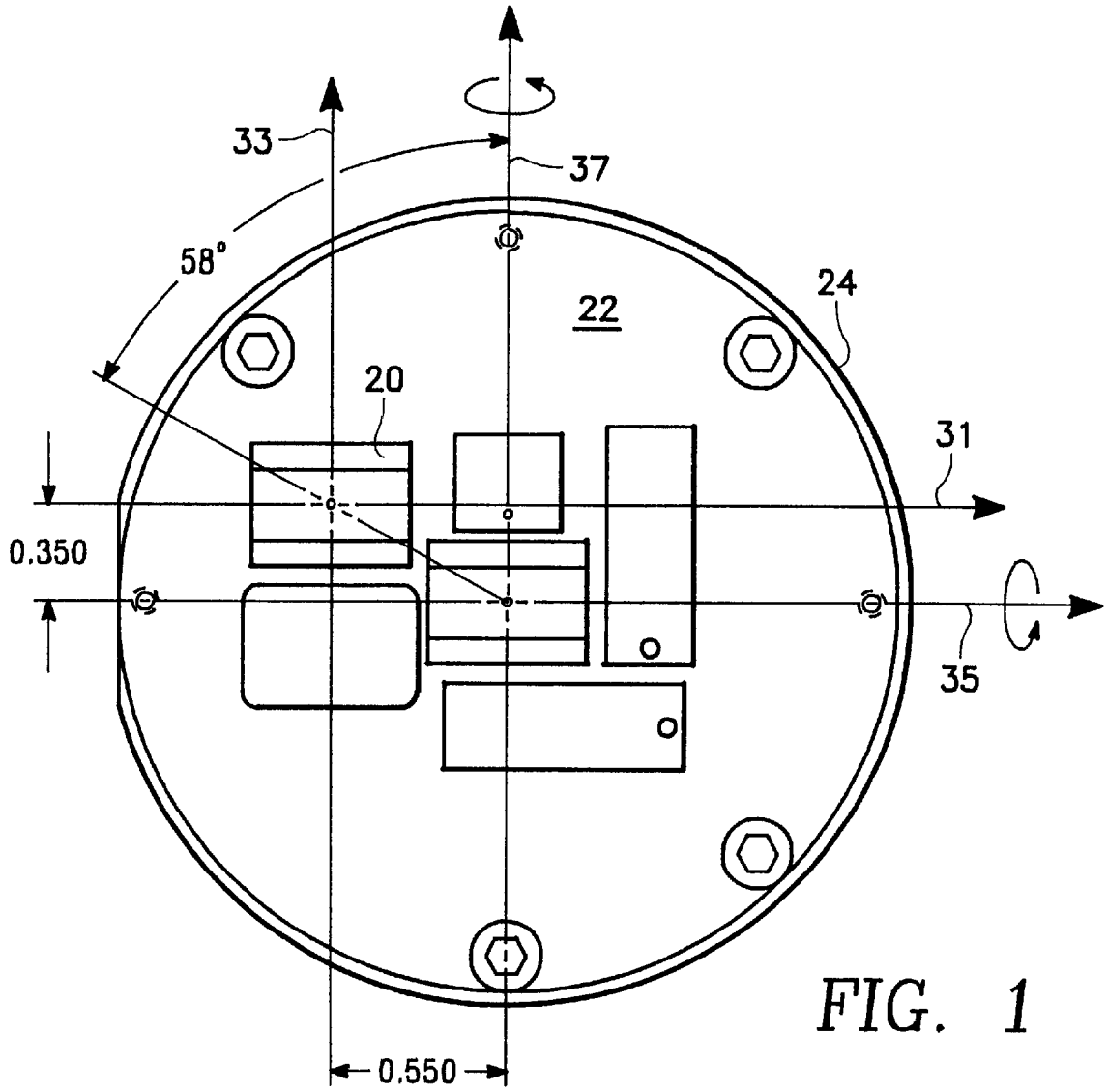
FIG. 1 is a schematic diagram of a magnetic sensor positioned within the inertial measurement unit of a small diameter missile.
Figure 2A:
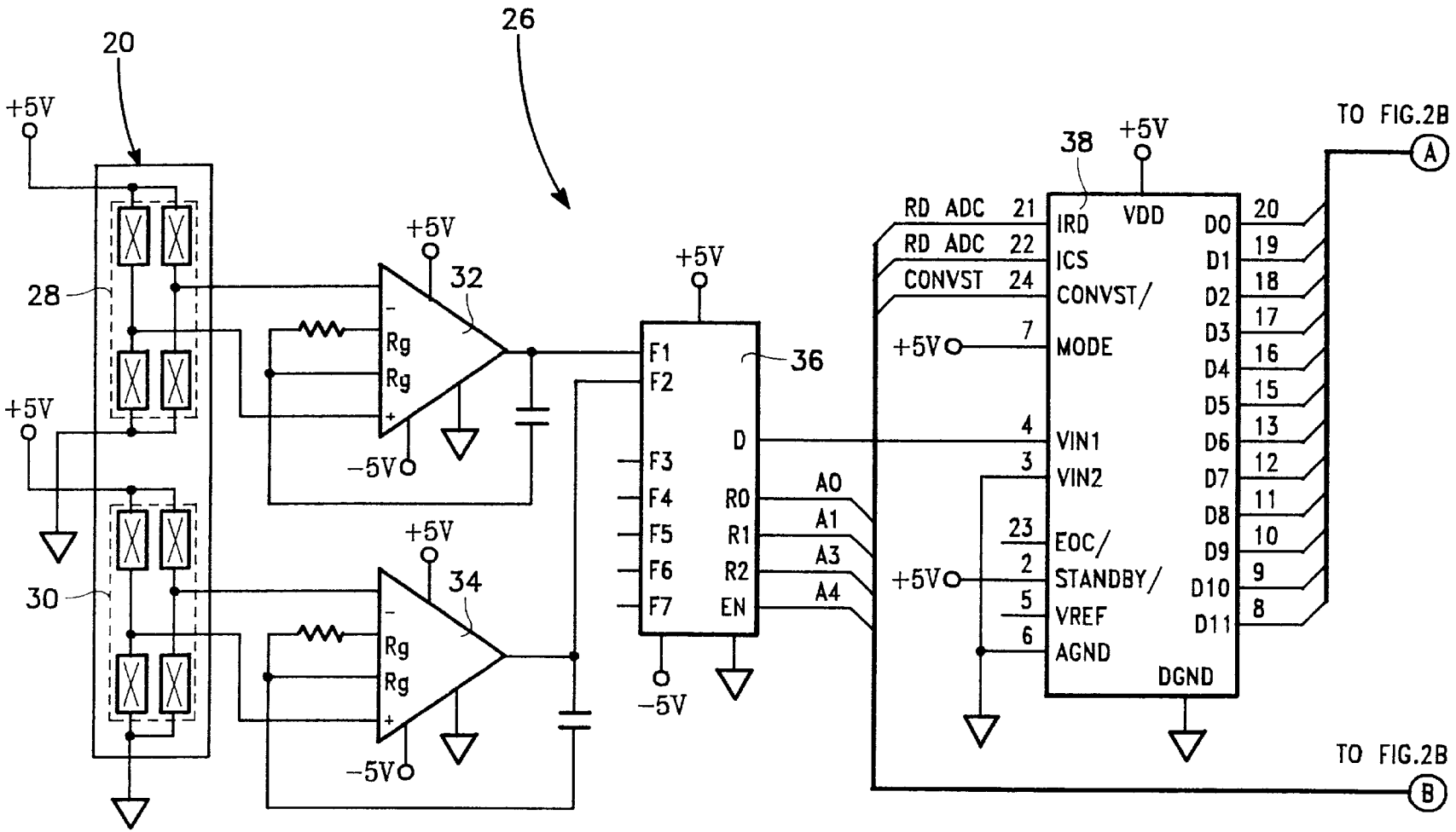
FIGS. 2A and 2B is a detailed electrical schematic diagram of a preferred embodiment of a magnetic roll rate sensor mounted within a small diameter missile.
Figure 2B:
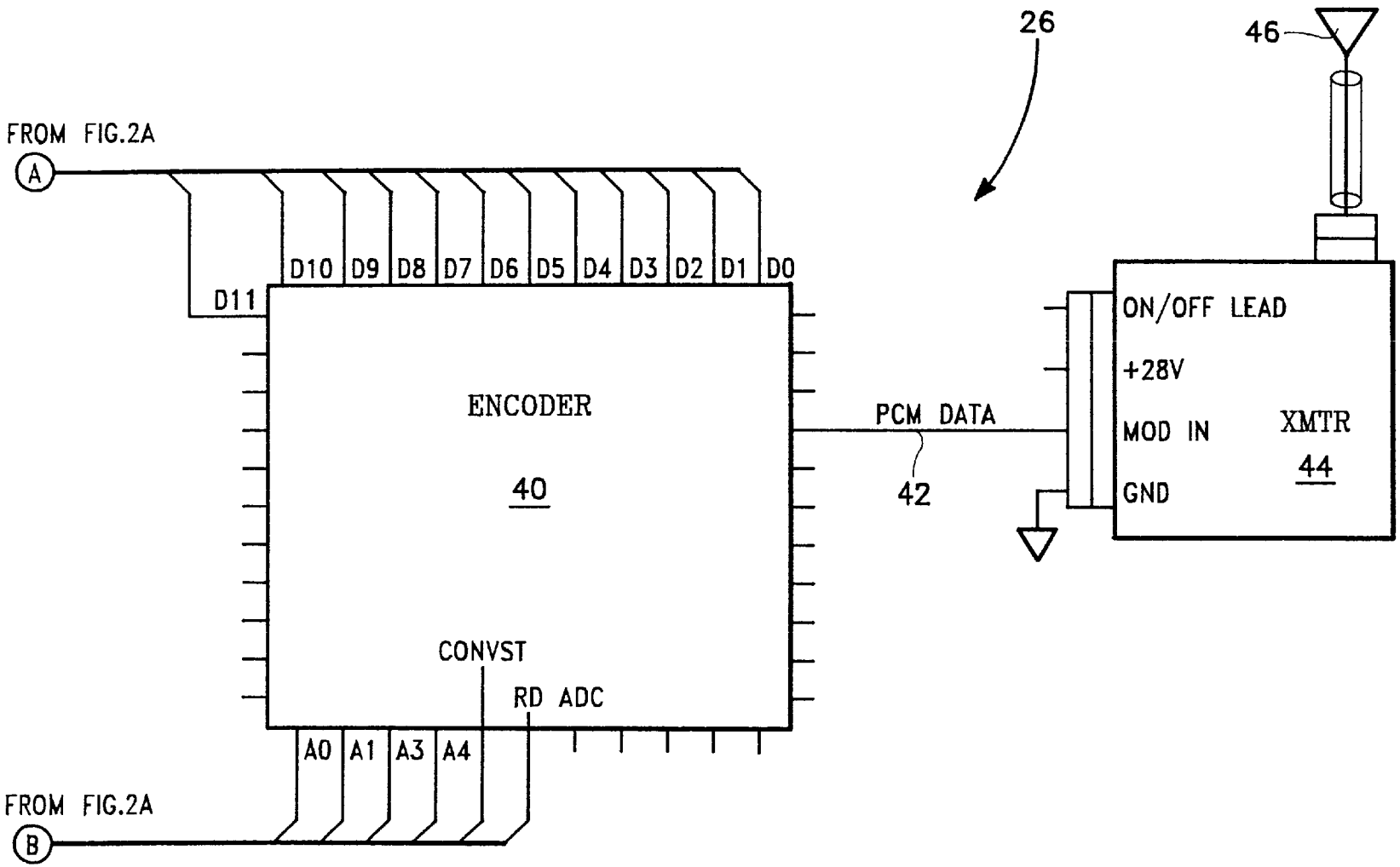

Referring first to FIGS. 1, 2A and 2B, there is shown in FIG. 1 a schematic or layout diagram of the positioning of a magnetic sensor 20, which is mounted on a circuit board 22 within the inertial measurement unit of a small diameter missile 24. Generally, a small diameter missile has a diameter of 2.75 inches or less. FIGS. 2A and 2B is a detailed electronic circuit diagram of a preferred embodiment of a magnetic roll rate sensor 26 which utilizes magnetic sensor 20 to measure the roll rate or roll position of a small diameter missile.

Referring to FIGS. 2A and 2B, magnetic roll rate sensor 26 comprises magnetic sensor 20 which is a two-axis magnetoresistive sensor having a pair of magnetic sensor elements 28 and 30. Magnetic sensors elements 28 and 30 which are orthogonal to one another and orthogonal to the roll axis of the missile 24. Magnetic sensors elements 28 and 30 sense change in the earth's magnetic field as the missile spins.

The magnetic sensor 20 used in the preferred embodiment is a Model HMC1002 two-axis magnetoresistive sensor commercially available from Honeywell Corporation Solid State Electronics Center of Plymouth, Minn. Magnetic Sensor 30 includes anisotropic magnetoresistance bridge circuits that measure magnetic fields and convert the measured magnetic fields to a differential output voltage.

The output of magnetic sensor element 28 is connected to a instrumentation amplifier 32, while the output of magnetic sensor 30 is connected to an instrumentation amplifier 34. Instrumentation amplifiers 32 and 34 are configured to operate as amplifiers and low pass filters. Each instrumentation amplifier 32 and 34 has a gain of 300 and a cutoff frequency $F_c$ of 200 Hz.

The analog electrical output signals provided by magnetic sensor elements 28 and 30, which are in the millivolt range, are supplied to amplifiers 32 and 34. These analog signals are amplified by amplifiers 32 and 34 which provide at their outputs signals of in a range of approximately ±1.25 volts. These signals are also filtered by amplifier 28 and 30 at the cutoff frequency of 200 Hz. This eliminates noise caused by the missile's seeker.

The amplified and filtered output signal from operational amplifier 32 is supplied to the Fl input of an analog multiplexer 36. Similarly, the amplified and filtered output signal from operational amplifier 34 is supplied to the F2 input of analog multiplexer 36.

Control signals for operating analog multiplexer 36 are supplied by PCM encoder 40. Multiplexer 36 receives an enable signal at its enable (EN) input from a PCM (pulse code modulation) encoder 40 via address line A4. Multiplexer also receives three select signals at its R0, R1 and R2 inputs which are provided by PCM encoder 40. When the A1, A1 and A2 address lines are logic zeros and multiplexer 36 receives an enable signal from PCM encoder 40, the output signal from amplifier 32 passes through multiplexer 36 to the VIN1 input to an analog to digital converter 38. When the A1 and A2 address lines are logic zeros and the A0 address line is a logic one, the output signal from amplifier 34 passes through multiplexer 36 to the VIN1 input to an analog to digital converter 38.

Control signals for operating analog to digital converter 38 are supplied by PCM encoder 40. A read analog to digital converter (RD ADC) signal is supplied to the IRD and ICS inputs of converter 38, while a convert start (CONVST) signal is supplied to the CONVST/input of converter 38. The CONVST signal when active low causes converter 38 to convert the analog signal to an equivalent 12 bit digital byte/word which is supplied to the D0–D11 inputs of PCM encoder 40. The RD ADC signal when active high allows PCM encoder 40 to read the digitized data.

At this time it should be noted that the input voltage range of the analog to digital converter 38 is ±2.5 volts. The added voltage range accommodates DC offsets and amplitude changes which occur when the seeker is turned on or the magnetic sensors are introduced into a different magnetic field.

PCM encoder 40 formats the 12 bit digital words into a serialized stream of PCM data in accordance with the IRIG 106 Telemetry Standard. IRIG 106 is a frame format developed by the Range Commander's Council, U.S. Army White Sands Missile Range, New Mexico, which is also in Industry and not just by the military. U.S. Pat. No. 5,745,849 fully describes the IRIG 106 Telemetry standard frame format and the disclosure of is incorporated U.S. Pat. No. 5,745,849 herein.

The PCM data is supplied via a PCM data line 42 to a transmitter 44 and its associated antenna 46. Antenna 46 transmits the PCM data via an RF link/signal to a ground station 48 with the electrical components for ground station 48 being illustrated in FIG. 3. Antenna 46 may be a microstrip antenna mounted on the missile 24.

Figure 3:
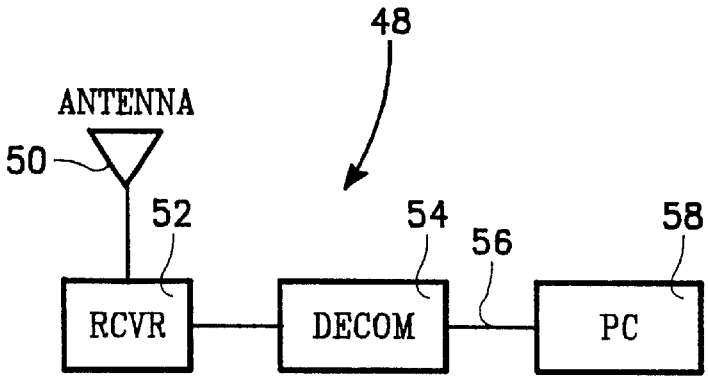
FIG. 3 is an electrical block diagram of a ground station's electrical components used for processing a PCM data stream received from the magnetic roll rate sensor of FIG. 2.

Referring to FIG. 3, ground station 48 includes antenna 50 and its associated receiver 52 which receives the RF signal transmitted by the antenna 46 of missile 24. The PCM data is then supplied to a decommutator 54 which decommutates and formats the data into an IBM-PC compatible format for processing by a IBM compatible personal computer 58. The serial data line 56 connecting decommutator 54 to computer 58 may be a RS-232 serial data line or representative of a data file compiled by the decommutator 54. The waveform generated by sensor element 30 is enveloped by reference numerals 94 and 96. The waveform generated by sensor element 28 is enveloped by reference numerals 92 and 98.

Figure 5:
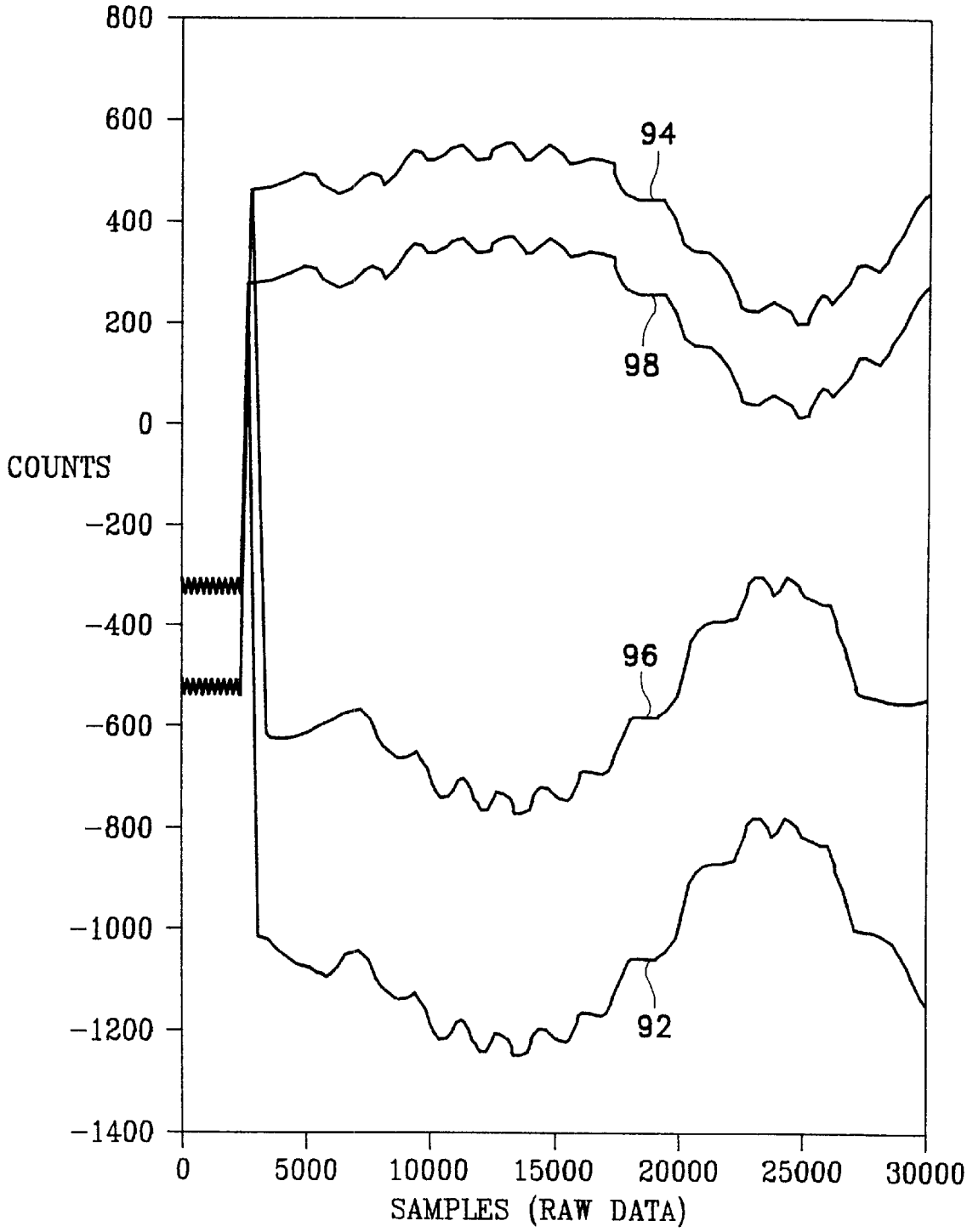
FIG. 5 is a plot illustrating the data provided by the magnetic sensors of roll rate sensor of FIG. 2 to the ground station of FIG. 3.

Referring to FIGS. 2A, 2B, 3 and 5, illustrates the roll rate sensor data provided by magnetic sensor elements 28 and 30 of magnetic sensor 20 after data is transmitted to the ground station 48 and decommutated by decommutator 54. The X-axis of FIG. 5 depicts the number of samples taken with the sample rate being 720 microseconds. The Y-axis of FIG. 5 depicts the digital count value provided by analog to digital converter 38 after conversion. Two's complement was used to provide signed count values. Because of the high spin rate, only the envelope of the signals are shown in FIG. 5.

The digital data from analog to digital converter 38 can be used to determine the direction of roll and the roll rate over a time interval of missile 24. The direction of roll for missile 24 is determined by which of the two magnetic sensor elements 28 or 30 leads the other magnetic sensor element. When the roll sensor, which is sensor element 28, is leading the roll90 sensor, which is sensor element 30, the missile 24 is rolling in a clockwise direction. When sensor element 30 is leading sensor element 28, the missile 24 is rolling in the counterclockwise direction. The roll rate for missile 24 is determined by counting the number of revolutions over a selected number of samples for a period of time.

The data set illustrated by the plot of FIG. 5 was collected while the missile 24 rolled at 15 revolutions per second and performed a plus and minus 25 degree pitch maneuver.

Referring to FIGS. 1, 2A, 2B, 4 and 5, sensor elements 28 and 30 are depicted as being 90 degrees out of phase with respect to each other as is best indicated by arrow 31 (representative of element 28) and arrow 33 (representative of element 30). This, in turn, results in sensor elements 28 and 30 being in quadrature which allows for a roll position determination for missile 24. The magnetic sensor 20 is positioned within the missile 24 off center 0.555 inches from the+vertical acceleration yaw axis 37 and 0.360 inches from+horizontal acceleration pitch axis 35. Longitudinal acceleration for the missile 24 is perpendicular to the pitch axis 35 and the yaw axis 37.

Figure 4:
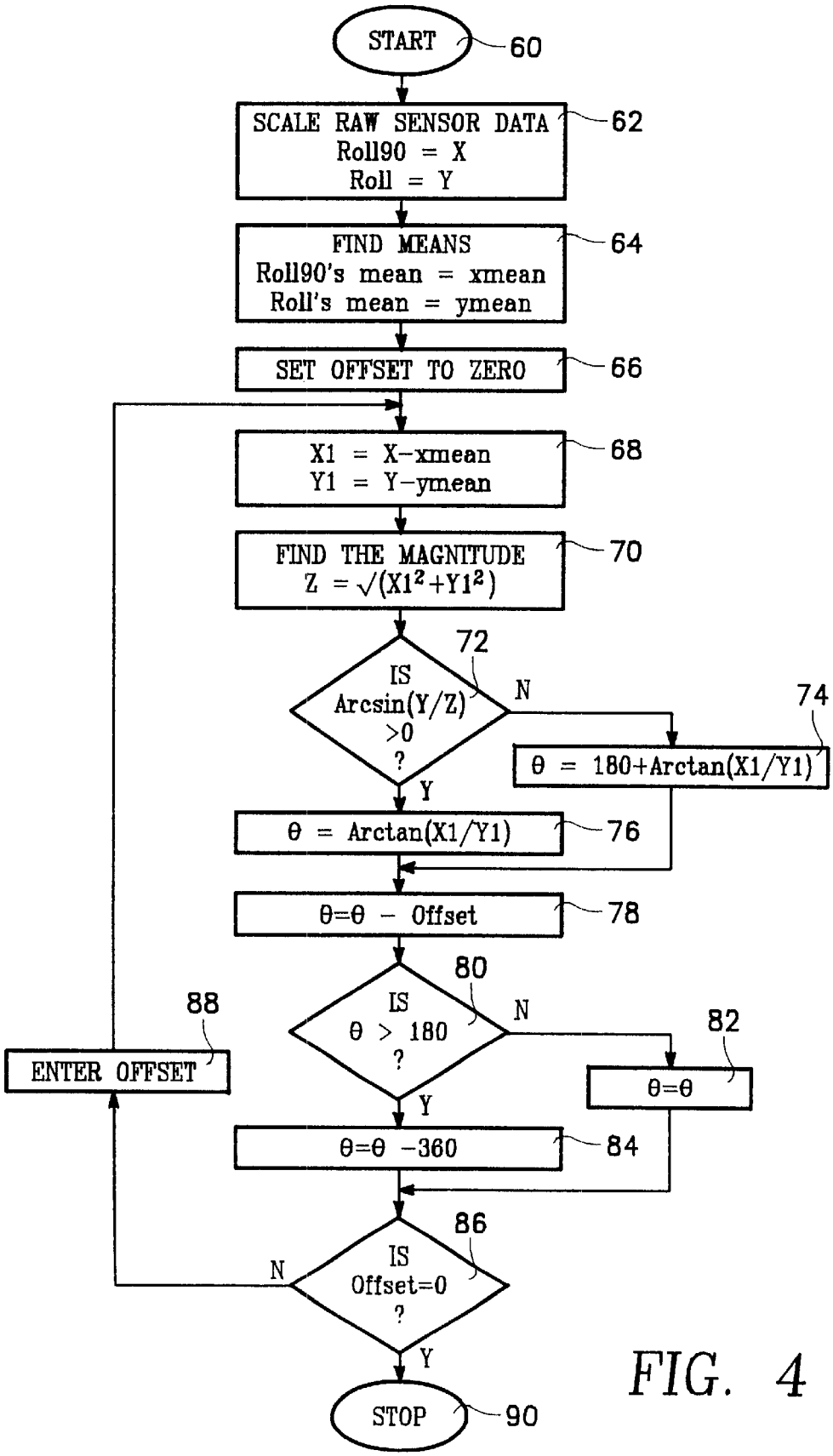
FIG. 4 is a flow chart for a computer software program used by a personal computer at the ground station to process data from the missile and calculate the roll rate for the missile.

The flow chart of FIG. 4 is for a computer software routine implementing an algorithm which performs quadrature detection to determine the roll position of missile 24. The X value are for Roll90 data from sensor element 30 and the Y values are for Roll data from sensor element 28. The macro for the algorithm is as follows:

```
Function Angle(x, xmean, y, ymean, Offset)
  X1=x−xmean
  Y1=y−ymean
  If Arc sin(Y1, Z(X1, Y1))>0 Then
    Angle=Arg(X1, Y1)
  Else
    Angle=180+Arg(X1, Y1)
  End If
  Angle=Angle−Offset
  If Angle>180 Then
    Angle=Angle−360
  Else
    Angle=Angle
  End If
End Function
Function Z(X1, Y1)
  Z=((X1*X1)+Y1*Y1))^0.5
End Function
Function Arg(X1, Y1)
  Arg=(180/3.141159)*Atn(X1/Y1)
End Function
Function Arc sin(Y1, Z)
  X2=(Y1/Z)
  Arc sin=(180/3.14159)*Atn(X2/Sqr(−X2*X2+1))
End Function
```

The roll rate sensor data is first scaled and the DC level for the data is determined (program step 62). As shown in FIG. 5, the roll sensor waveform enveloped by reference numerals 92 and 98, which is generated by sensor element 28, has a larger swing than the roll90 sensor waveform enveloped by reference numerals 94 and 96, which is generated by sensor element 30. This requires that a scaling be calculated with the calculation being made by computer 58 the first time computer 58 executes the program illustrated by FIG. 4. The peak to peak swing of one the sensors 28 or 30 during a sample interval is found. The data from the other sensor 28 or 30 is then scaled such the data has the same peak to peak swing over the same sampling interval.

The DC level is determine by is calculated by averaging sensor rate data over a large sampling interval while the missile 24 is rolling and is defined by xmean and ymean (program step 64). The offset is an angle that corrects the roll rate data so that the data starts at zero. Initially the offset is set to zero (program step 66).

Quadrature detection is performed by calculating the arc tangent of Roll90 over Roll. The arc tangent function of program step 76 calculates values between ±90 degrees, however the values required are between ±180 degrees. The software illustrated in FIG. 4 first determines which quadrant the angle is located in. This is accomplished in program step 70 by finding the Magnitude of Z in accordance with the following expression:

$$Z=\sqrt{X1^2Y1^2} \quad (1)$$

The arcsine of Y/Z is then determined in program step 72. When the arc sine is positive, that is the Arc sine(Y/Z) is greater than zero, the roll position is equal to the arctangent of X/Y (program step). When the arc sine is negative, 180 degrees is added to the calculated roll position (program step 74). During program step 78 the offset is subtracted from the roll position calculated in program step 72 or program step 74. Program steps 80, 82 and 84 correct the roll position calculation so that it stays between ±180 degrees.

Figure 6:
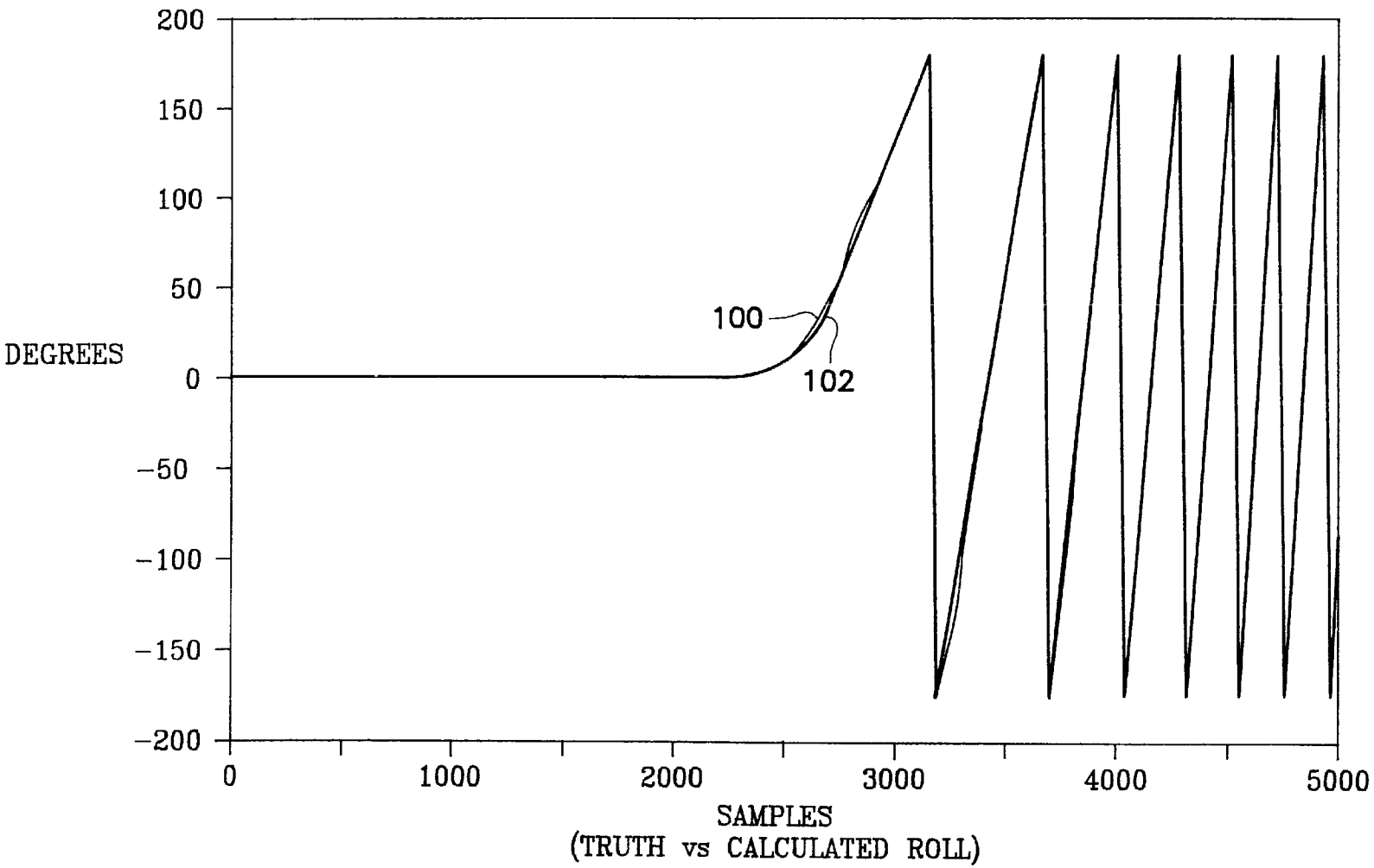
FIG. 6 is a plot which allows for a comparison of the calculated roll position obtained from the software of FIG. 4 and roll data provided by a missile simulation system which simulates a missile in flight.

When the algorithm of FIG. 4 is used to process the data of FIG. 5, roll position is derived in the manner illustrated in FIG. 6. FIG. 6 contains the first five thousand samples of FIG. 5 which allows for a comparison of the calculated roll position obtained from the software of FIG. 4 and roll data provided by a missile simulation system which simulates a missile in flight. The missile simulation system data was taken while the missile was rolling at 15 revolutions per second and the missile performed a plus and minus 25 degree pitch maneuver. The missile simulation provides data for the Pitch, Yaw and Roll position of the missile. In FIG. 6, the calculated roll data is identified by the reference numeral 100 and the simulation generated roll data is identified by the reference numeral 102. The X-axis of FIG. 6 is samples and the Y-axis of FIG. 6 is degrees. The plots of FIG. 6 show that the calculated roll data 100 follows the simulation generated roll data 102 very closely. From the plots of FIG. 6, it was determined that the peak error was about ten degrees and that the error had a periodic function. The spikes in the data occur when the data wraps from ±180 degrees to −180 degrees. Error in the roll data will most likely be corrected by positioning the magnetic sensor 20 and its sensor elements 28 and 30 in the middle of the roll axis for missile 24. The 58 degree offset shown in FIG. 1 occurs exactly where the peak error of about 10 degrees occurs.

From the foregoing, it may readily be seen that the present invention comprises a new unique and exceedingly useful, apparatus for measuring the roll position of a missile in flight which constitutes a considerable improvement over the known prior art. Many modifications and variation of the present invention are possible in light of the above teachings. It is therefore to be understood that within the scope of the appended claims that the invention may practiced otherwise than, as specifically described.

What is claimed is:

1. A magnetic roll rate sensor apparatus for determining a roll position for a missile in flight comprising:

first sensing means mounted within said missile for measuring said roll position for said missile and generating a first analog signal representative of said roll position for said missile;

second sensing means mounted within said missile, said first and second sensing means being orthogonal to one another and orthogonal to a roll axis for said missile, said second sensing means generating a second analog signal representative of said roll position for said missile;

first amplifier means for amplifying said first analog signal and filtering said first analog signal to eliminate noise generated by a seeker within said missile from said first analog signal;

second amplifier means for amplifying said second analog signal and filtering said second analog signal to eliminate noise from said second analog signal;

multiplexer means for receiving said first and second analog signal respectively from said first and second amplifying means and then multiplexing said first and second analog signals allowing said first and second analog signals to pass through said multiplexer means and form one continuous analog signal;

conversion means for converting said one continuous analog signal to a plurality of digital data words;

encoding means for encoding said digital data words into a pulse code modulation (PCM) data stream;

transmitting means located on said missile for transmitting a radio frequency signal which includes said PCM data stream to a ground station;

receiving means located at said ground station to receive said radio frequency signal from said missile;

decoding means for decoding said PCM data stream extracting said digital data words from said PCM data stream; and computer means for receiving said digital data words from said decoding means and processing said digital data words to determine said roll position for said missile.

2. The apparatus of claim 1 wherein said first and second amplifier means comprise instrumentation amplifiers.

3. The apparatus of claim 2 wherein said first and second amplifier means have a gain of approximately 300 and a cutoff frequency of 200 Hertz.

4. The apparatus of claim 1 wherein said multiplexer means comprises an analog multiplexer.

5. The apparatus of claim 1 wherein said conversion means comprises an analog to digital converter.

6. The apparatus of claim 1 wherein said transmitting means comprises:

a transmitter having an input connected to an output of said encoding means and an output; and a microstrip antenna mounted on said missile, said microstrip antenna being electrically connected to the output of said transmitter.

7. The apparatus of claim 1 wherein said receiving means comprises:

a receiving antenna for receiving said radio frequency signal from said missile; and a receiver having an input electrically connected to said receiving antenna and an output connected to said decoding means.

8. The apparatus of claim 1 wherein said decoding means comprises a decommutator.

9. The apparatus of claim 1 wherein said computer means comprises a digital computer which has computer software for determining said roll position for said missile.

10. A magnetic roll rate sensor apparatus for determining a roll position for a missile in flight comprising:

a first magnetic sensor element mounted within said missile for measuring said roll position for said missile and generating a first analog signal representative of said roll position for said missile;

a second magnetic sensor element mounted within said missile, said first and second magnetic elements being orthogonal to one another and orthogonal to a roll axis for said missile, said second magnetic sensor element generating a second analog signal representative of said roll position for said missile;

a first instrumentation amplifier connected to said first magnetic sensor element to receive said first analog signal, said first instrumentation amplifier amplifying said first analog signal and filtering said first analog signal to eliminate noise generated by a seeker within said missile from said first analog signal;

a second instrumentation amplifier connected to said first magnetic sensor element to receive said second analog signal, said first instrumentation amplifier amplifying said second analog signal and filtering said second analog signal to eliminate noise generated by a seeker within said missile from said second analog signal;

an analog multiplexer connected to said first and second instrumentation amplifiers to receive said first and second analog signals and then multiplex said first and second analog signals allowing said first and second analog signals to pass through said analog multiplexer and form one continuous analog signal at an output of said analog multiplexer;

an analog to digital converter connected to said analog multiplexer to receive said one continuous analog signal, said analog to digital converter converting said one continuous analog signal to a plurality of digital data words;

an encoder connected to said analog to digital converter, to receive said plurality of said digital data words said encoder encoding said digital data words into a pulse code modulation (PCM) data stream;

a transmitter connected to said encoder to receive said PCM data stream, said transmitter including a microstrip antenna located on said missile, said microstrip antenna transmitting a radio frequency signal which includes said PCM data stream to a ground station;

a receiver located at said ground station, said receiver having a receiving antenna for receiving said radio frequency signal which includes said PCM data stream from said missile;

a decoder connected to said receiver, said decoder receiving said PCM data stream from said receiver and decoding said PCM data stream extracting said digital data words from said PCM data stream; and a digital computer connected to said decoder to receive said digital data words from said decoder, said digital computer processing said digital data words to determine said roll position for said missile.

11. The apparatus of claim 10 wherein said first and second amplifier means have a gain of approximately 300 and a cutoff frequency of 200 Hertz.

12. The apparatus of claim 10 wherein said decoder comprises a decommutator.

13. The apparatus of claim 10 wherein said digital computer which has computer software for determining said roll position for said missile.

14. A magnetic roll rate sensor apparatus for determining a roll position for a missile comprising:

a magnetic sensor mounted within said missile, said magnetic sensor having a first magnetic sensor element and a second magnetic sensor element, said first and said second magnetic sensor elements being orthogonal to one another and orthogonal to a roll axis for said missile, said first and second magnetic sensor elements each having a differential output;

a first amplifier having a differential input connected to the differential output of said first magnetic sensor element, said first amplifier having an output;

a second amplifier having a differential input connected to the differential output of said second magnetic sensor element, said second amplifier having an output;

a multiplexer having a first signal input connected to the output of said first amplifier, a second signal input connected to the output of said second amplifier, a plurality of address inputs, a control input and a signal output;

an analog to digital converter having a signal input connected to the signal output of said multiplexer, a plurality of control inputs and a plurality of data outputs;

a PCM (pulse code modulation) encoder having a plurality of data inputs connected to the data outputs of said analog to digital converter, a plurality of address outputs connected to the address inputs of said multiplexer, a plurality of control outputs, one of said plurality of control outputs being connected to the control input of said multiplexer and the remainder of said plurality of control outputs being connected to the control inputs of said analog to digital converter, said PCM encoder having an output;

a transmitter having an input connected to the output of said PCM encoder and an output; and a transmitting antenna mounted on said missile, said transmitting antenna being electrically connected to said transmitter.

15. The apparatus of claim 14 further comprising:

a receiving antenna located at a ground station, said receiving antenna being positioned to receive radio frequency signals transmitted from said missile by said transmitting antenna;

a receiver having an input electrically connected to said receiving antenna and an output;

a decommutator having an input connected to the output of said receiver and an output; and a computer having an input connected to the output of said decommutator.

16. The apparatus of claim 13 wherein said magnetic sensor comprises is a two-axis magnetoresistive sensor having said first and second magnetic sensor elements.

17. The apparatus of claim 13 wherein said first amplifier and said second amplifier each comprise an instrumentation amplifier.

18. The apparatus of claim 13 wherein said multiplexer comprises an analog multiplexer.

19. The apparatus of claim 13 wherein said first and second amplifiers have a gain of approximately 300 and a cutoff frequency of 200 Hertz.

20. The apparatus of claim 13 wherein said computer comprises a digital computer.

* * * * *